US005735298A

United States Patent [19]

Mayne et al.

[11] Patent Number: 5,735,298

[45] Date of Patent: Apr. 7, 1998

[54] TRI-FOLD MULTIPURPOSE TOOTHBRUSH

[76] Inventors: Harlo Mayne; P. Dustin McNeill, both of 569 Washington St., Quincy, Mass. 02169

[21] Appl. No.: 651,211

[22] Filed: May 22, 1996

[51] Int. Cl.[6] ..... A45D 44/18; A46B 11/00

[52] U.S. Cl. ..... 132/309; 132/311; 15/167.1; 15/185

[58] Field of Search ..... 132/308, 309, 132/310, 311, 323, 325, 326, 327, 328, 316; 15/184, 185, 167.1; 433/141, 142, 143, 147, 30, 31

[56] References Cited

U.S. PATENT DOCUMENTS

| | | | |
|---|---|---|---|
| 949,587 | 2/1910 | Ludington | 132/311 |
| 1,153,801 | 9/1915 | Long | 15/185 |
| 1,168,689 | 8/1916 | Smith et al. | 132/311 |
| 1,661,200 | 3/1928 | Spitz | 132/311 |
| 2,083,728 | 6/1937 | Mayer | 15/185 |
| 2,247,003 | 6/1941 | Smith et al. | 132/311 |
| 2,505,547 | 4/1950 | Howard | 15/185 |
| 3,763,869 | 10/1973 | Sanders | 132/311 |
| 4,731,896 | 3/1988 | De La Tour | 15/167.1 |
| 5,127,415 | 7/1992 | Preciutti | 132/323 |
| 5,581,838 | 12/1996 | Rocco | 132/323 |

*Primary Examiner*—Todd E. Manahan
*Attorney, Agent, or Firm*—Michael I. Kroll

[57] ABSTRACT

A tri-fold multipurpose toothbrush (14) which comprises a component (16) for cleaning teeth. An arm assembly (18) is provided. A unit (20) on a first end of the arm assembly (18) is for retaining the teeth cleaning components (16) thereto in a removable manner. A case (22) is also provided. A member (24) at a second end of the arm assembly (18) is for pivoting the arm assembly (18) on a first end of the case (22). The arm assembly (18) with the teeth cleaning component (16) can fold down upon the case (22) when not in use and can fold out from the case (22) when in use. An assemblage (26) is for locking the arm assembly (18) in any angle when folded out from the case (22). A handle (28) is also provided, having a recessed area (30). Another member (32) at a first end of the handle (28) is for pivoting the handle (28) on a second end of the case (22). The handle (28) can fold down upon the case (22) with the recessed area (30) over the arm assembly (18) with the teeth cleaning component (16) when not in use. The handle (28) can fold out from the case (22) to be gripped by a hand of a person when in use.

18 Claims, 5 Drawing Sheets

Fig. 1
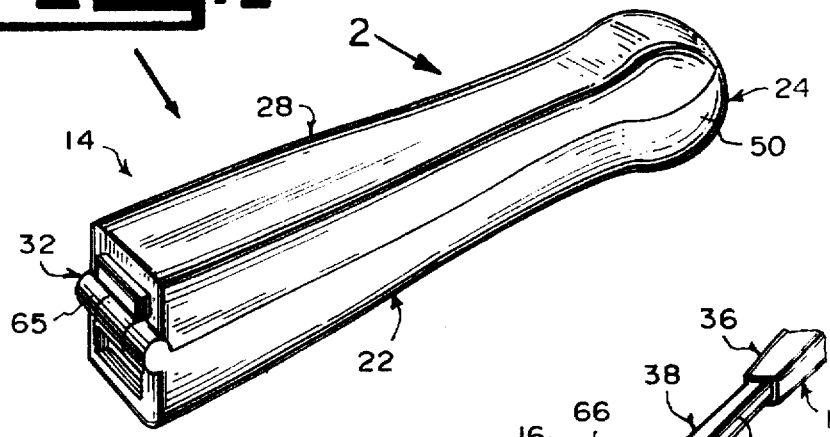
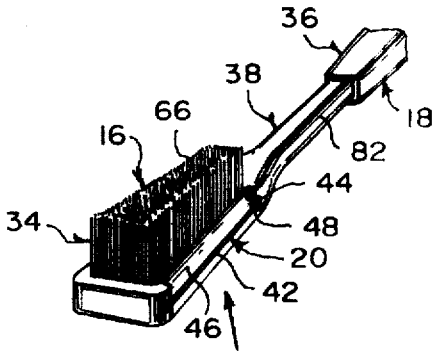
Fig. 3
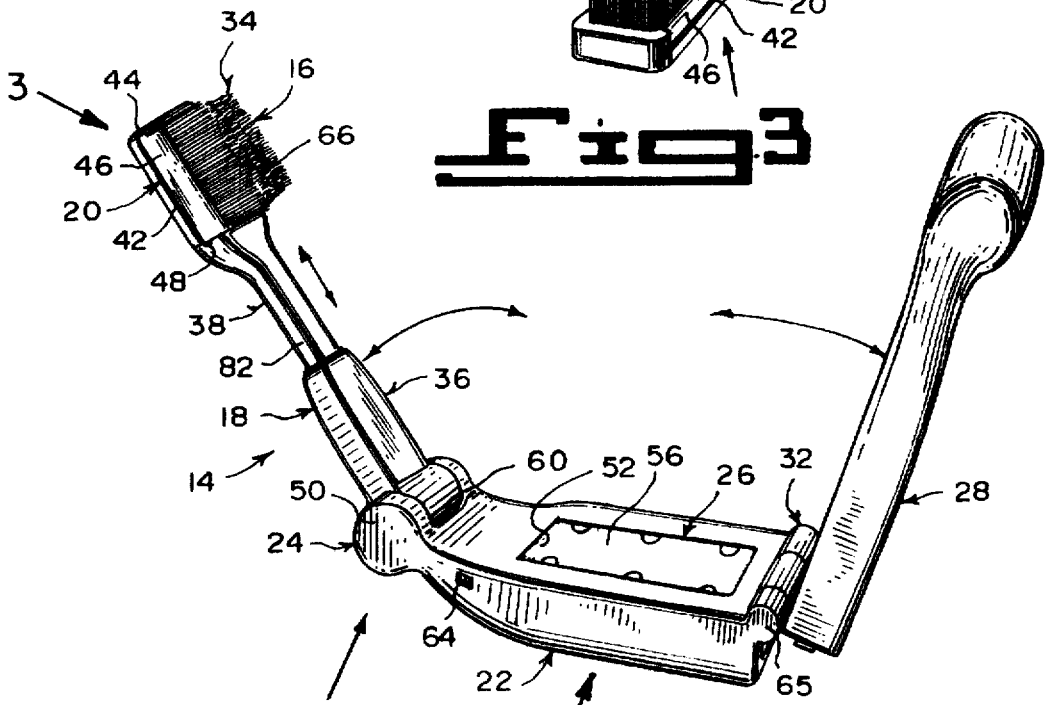
Fig. 2
Fig. 4
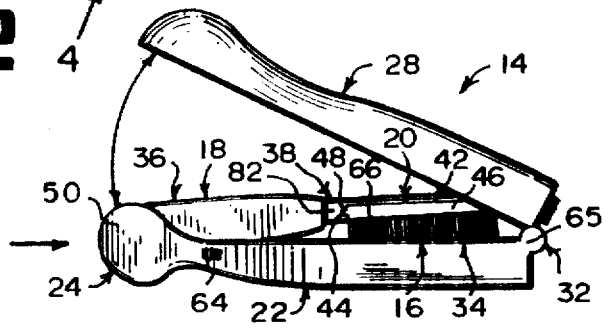

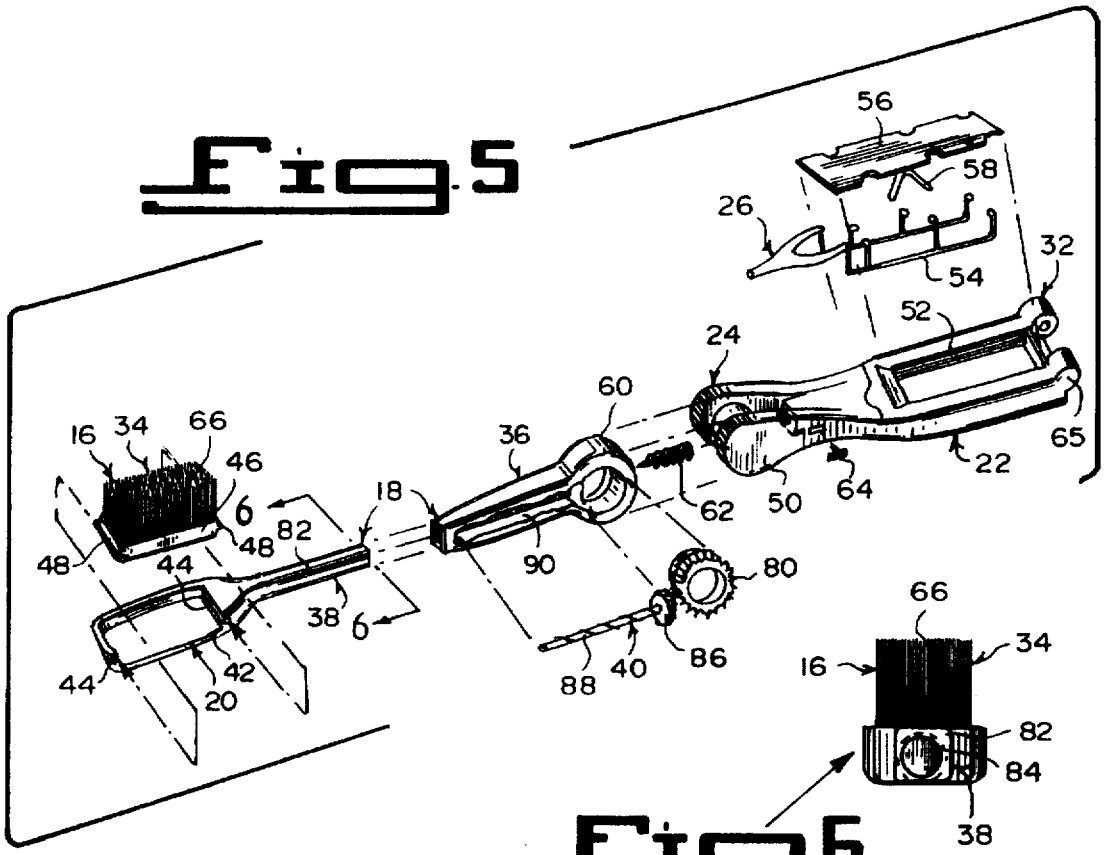
Fig. 5
Fig. 6
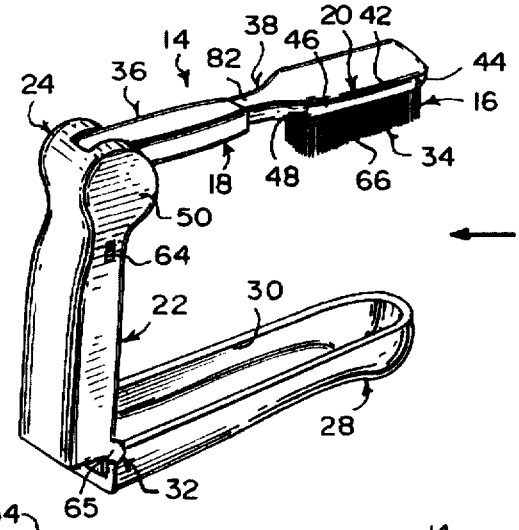
Fig. 7
Fig. 8
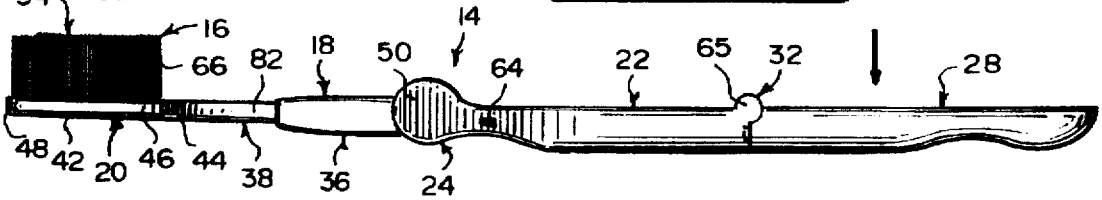

TRI-FOLD MULTIPURPOSE TOOTHBRUSH

BACKGROUND OF THE INVENTION

1. Field of the Invention

The instant invention relates generally to dental care devices and more specifically it relates to a tri-fold multipurpose toothbrush.

2. Description of the Prior Art

Numerous dental care devices have been provided in prior art that are adapted to clean the teeth of people, such as toothbrushes, dental floss and water picks. While these units may be suitable for the particular purpose to which they address, they would not be as suitable for the purposes of the present invention as heretofore described.

SUMMARY OF THE INVENTION

A primary object of the present invention is to provide a tri-fold multipurpose toothbrush that will overcome the shortcomings of the prior art devices.

Another object is to provide a tri-fold multipurpose toothbrush that will combine a common toothbrush, an angled toothbrush, a compact travel toothbrush and a small toothbrush case all into a single unit, which folds up in thirds into a closed compact stored position when not in use.

An additional object is to provide a tri-fold multipurpose toothbrush that contains interchangeable periodontal attachment heads, which can be used to perform various tasks in cleaning teeth.

A further object is to provide a tri-fold multipurpose toothbrush that is simple and easy to use.

A still further object is to provide a tri-fold multipurpose toothbrush that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

Various other objects, features and attendant advantages of the present invention will become more fully appreciated as the same becomes better understood when considered in conjunction with the accompanying drawings, in which like reference characters designate the same or similar parts throughout the several views, and wherein;

FIG. 1 is a perspective view of the instant invention in a completely folded up closed position.

FIG. 2 is a perspective view of the instant invention taken in the direction of arrow 2 in FIG. 1, in a partly opened position.

FIG. 3 is a perspective view taken in the direction of arrow 3 in FIG. 2 with parts broken away, showing the bristle toothbrush attachment inserted into the socket in the head extension.

FIG. 4 is a side view of the instant invention taken in the direction of arrow 4 in FIG. 2 in an almost closed position.

FIG. 5 is an exploded perspective view with parts broken away and removed, showing the various components thereof.

FIG. 6 is an enlarged end view taken along line 6—6 in FIG. 5.

FIG. 7 is a perspective view, showing the instant invention in the partly opened position at a different angle than in FIG. 2.

FIG. 8 is a side view, showing the instant invention in the fully opened position.

Similar reference characters denote corresponding features consistently throughout the attached drawings.

DETAILED DESCRIPTION OF THE PREFERRED EMBODIMENTS

Figure 9:
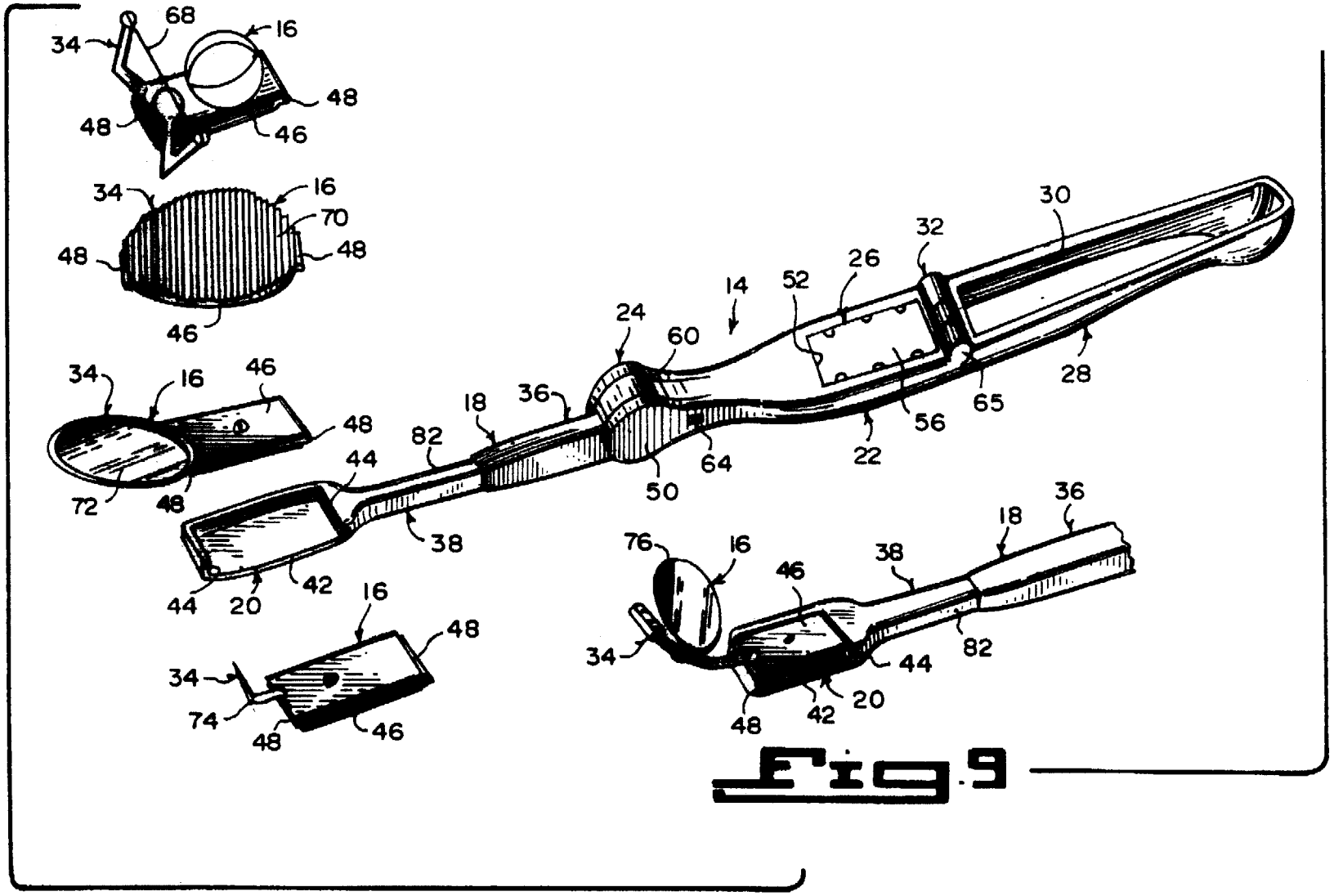
FIG. 9 is a perspective view, showing the instant invention in the fully opened position as in FIG. 8 and various interchangeable periodontal attachments other than the toothbrush bristle attachment, which can be inserted into the socket in the head extension.
Figure 10:
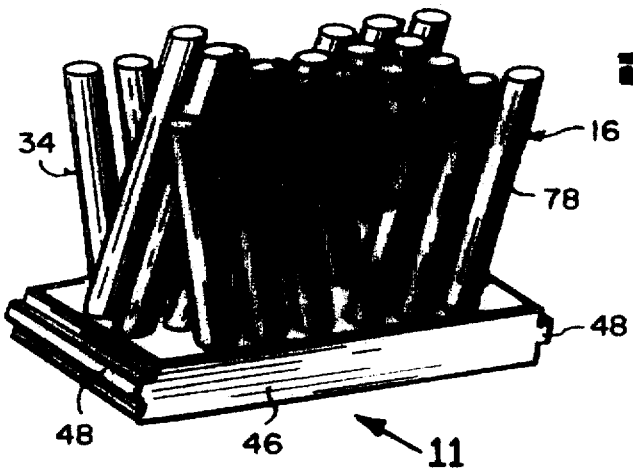
FIG. 10 is an enlarged perspective view of a cross-bristle toothbrush attachment.
Figure 11:
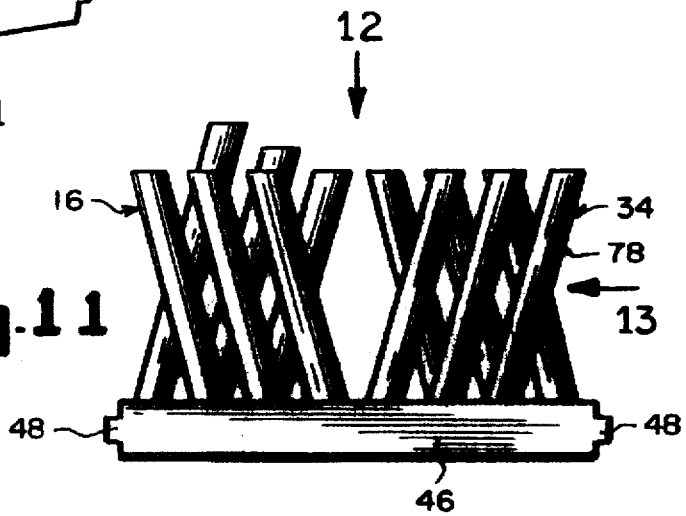
FIG. 11 is an elevational view taken in the direction of arrow 11 in FIG. 10.
Figure 12:
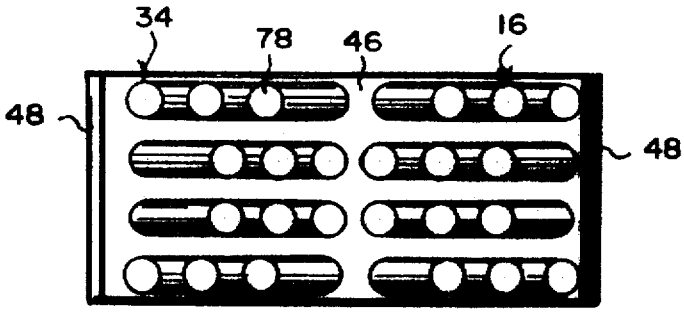
FIG. 12 is a top view taken in the direction of arrow 12 in FIG. 11.
Figure 13:
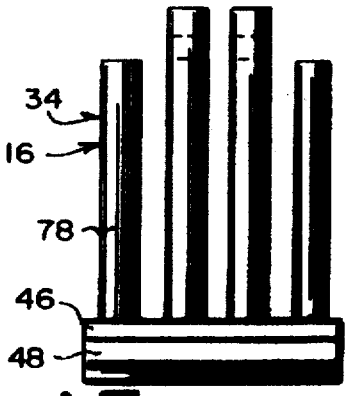
FIG. 13 is an end view taken in the direction of arrow 13 in FIG. 11.

Turning now descriptively to the drawings, in which similar reference characters denote similar elements throughout the several views, FIGS. 1 through 9 illustrate a tri-fold multipurpose toothbrush 14 which comprises a component 16 for cleaning teeth. An arm assembly 18 is provided. A unit 20 on a first end of the arm assembly 18 is for retaining the teeth cleaning component 16 thereto in a removable manner. A case 22 is also provided. A member 24 at a second end of the arm assembly 18 is for pivoting the arm assembly 18 on a first end of the case 22.

The arm assembly 18 with the teeth cleaning component 16 can fold down upon the case 22 when not in use and can fold out from the case 22 when in use. As assemblage 26 is for locking the arm assembly 18 in any angle when folded out from the case 22. A handle 28 is also provided, having a recessed area 30. Another member 32 at a first end of the handle 28 is for pivoting the handle 28 on a second end of the case 22. The handle 28 can fold down upon the case 22 with the recessed area 30 over the arm assembly 18 with the teeth cleaning component 16 when not in use. The handle 28 can fold out from the case 22 to be gripped by a hand of a person when in use.

The teeth cleaning component 16 is a periodontal head 34. The arm assembly 18 includes a joint extension 36 and a head extension 38, in which a part thereof slides within the joint extension 36.

The tri-fold multipurpose toothbrush 14, as best seen in FIG. 5, further includes paraphernalia 40 extending within the joint extension 36 and the head extension 38, for retracting part of the head extension 38 into the joint extension 36, when folded down upon the case 22 and for extending part of the head extension 38 out from the joint extension 36, when fold out from the case 22. The retaining unit 20 consists of the arm assembly 18 having an open side socket 42 with a groove 44 formed in each opposite end of the socket 42. The teeth cleaning component 16 has a base 46 with a tongue 48 formed on each opposite ends of the base 46. The base 46 can slide within the socket 42 with the tongues 48 in engagement with the grooves 44. The first pivoting member 24 is a joint 50 formed on the second end of the arm assembly 18 and the first end of the case 22.

The locking assemblage 26, as best seen in FIG. 5, comprises the case 22 having a top compartment 52. A locking rod extension unit 54 is carried in the top compartment 52. A cover plate thumb grip 56 with spring 58 is placed over the locking rod extension unit 54 in the top compartment 52. The cover plate thumb grip 56 can be depressed into the top compartment 52 by the teeth cleaning component 16, when the arm assembly 18 is folded down and by a thumb of a person when the arm assembly 18 is folded out.

The first pivoting member 24 at the second end of the arm assembly 18 has gear teeth 60 thereon. A spring biased pin 62 is carried in the case 22 and is in engagement with the locking rod extension unit 54. When the cover plate thumb grip 56 is depressed down by the thumb of the person, the pin 62 will engage with the gear teeth 60 to hold the arm assembly 18 stationary at an angle thereto. A slide button 64 is carried on the case 22 and is in engagement with the pin 62, so that when the button 64 is manually pulled back the pin 62 will disengage from the gear teeth 60, to allow the arm assembly 18 to pivot freely on the first pivoting item 24.

The second pivoting member 32 is a hinge 65 formed on the first end of the handle 28 and the second end of the case 22. The periodontal head 34 can consist of a bristle toothbrush attachment 66, as shown in FIGS. 2 to 8, a dental floss attachment 68, a tongue massager/scrapper attachment 70, a dental mirror attachment 72, a tartar scrapper attachment 74, a flexible dental mirror attachment 76, all shown in FIG. 9 and a cross-bristle toothbrush attachment 78, shown in FIGS. 10 to 13.

The retracting and extending paraphernalia 40 includes a first spiral bevel gear 80 carried within the first pivoting member 24. The head extension 38 has a shank 82 with a threaded bore 84 therein (see FIG. 6). A second smaller spiral bevel gear 86 is in engagement with the first spiral bevel gear 80 with intersecting axes. A screw rod 88 is affixed at one end to the second smaller spiral bevel gear 86. The screw rod 88 and the second smaller spiral bevel gear 86 are rotatively carried within an aperture 90 in the joint extension 36. A free end of the screw rod 88 is threaded into the threaded bore 84 in the shank 82 of the head extension 38. When the joint extension 36 folds down on the case 22, the shank 82 of the head extension 38 will be pulled into the joint extension 36.

Figure 14:
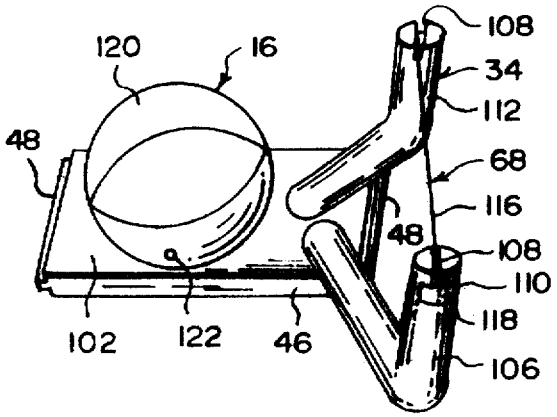
FIG. 14 is an enlarged perspective view of the dental floss attachment shown in FIG. 9.
Figure 15:
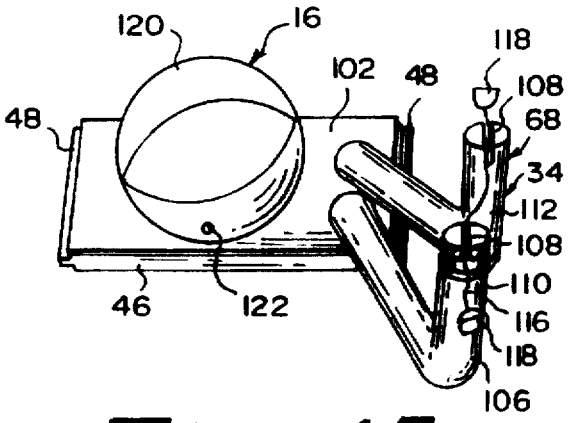
FIG. 15 is an enlarged perspective view similar to FIG. 14, showing the movable arm pushed closer to the stationary arm to change the floss.
Figure 16:
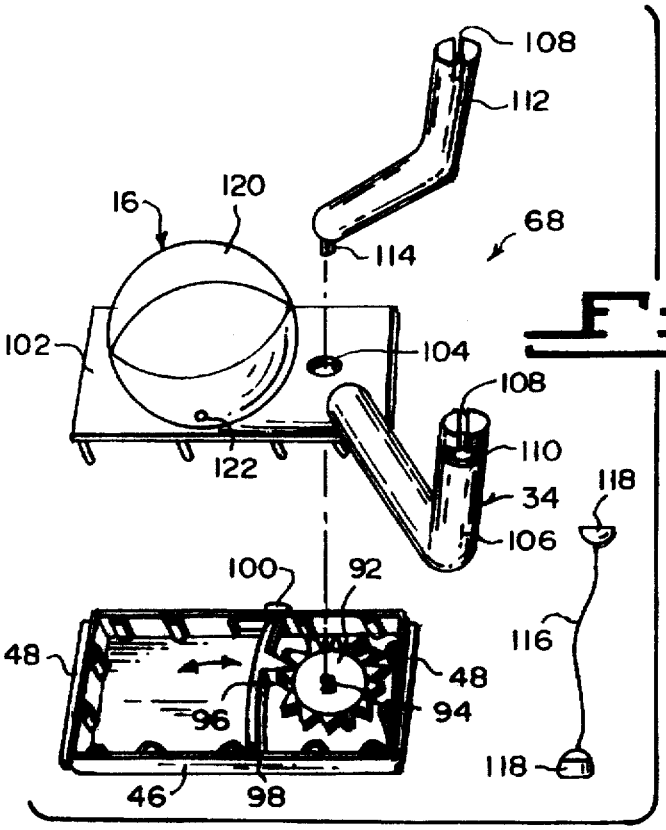
FIG. 16 is an enlarged exploded perspective view of the dental floss attachment, showing the various components thereof.

The dental floss attachment 68, as best seen in FIGS. 14, 15 and 16 consists of the base 46 being hollow. A ratchet wheel 92 has a central socket 94 and is rotatively mounted within the base 46. A pawl arm 96 is pivotally mounted at one end 98 within the base 46 at a first side thereof and has a button 100 extending outwardly from a second side of the base 46. A person can manually operate the pawl arm 96 to engage with and disengage with the ratchet wheel 92. A cover 102 is provided having an aperture 104 therethrough. The cover 102 is connected onto the base 46, so that the aperture 104 will be over the central socket 94 of the ratchet wheel 92. A stationary bent arm 106 is affixed to the cover 102. The stationary bent arm 106 has a top slot 108 with a side indent 110. A movable bent arm 112 has a bottom plug 114 and a top slot 108 with a side indent 110. The bottom plug 114 can engage with the central socket 90 of the ratchet wheel 92, through the aperture 104 in the cover 102.

A piece of dental floss 116 has a projection 118 on each end thereof. When the pawl arm 96 is disengaged from the ratchet wheel 92, the movable bent arm 112 can be pushed closer to the stationary bent arm 106 to allow the piece of dental floss 116 to be inserted into the top slots 108. The movable bent arm 112 can be pulled away from the stationary bent arm 112, causing the projections 118 to lock into the side indents 110 with the piece of dental floss 116 becoming taut therebetween. A compressible hollow ball 120 is molded to the cover 102. A small valve 122 is in the ball 120, to release air slowly and prevents the piece of dental floss 116 from slipping too quickly between teeth, due to force, and injure the gum. When pressure is removed from the ball 120, the valve 122 will allow quick air intake back into the ball 120 to return the ball 120 to its original shape.

LIST OF REFERENCE NUMBERS

14 tri-fold multipurpose toothbrush
16 teeth cleaning component of 14
18 arm assembly of 14
20 retaining unit of 14
22 case of 14
24 first pivoting member of 14
26 locking assemblage of 14
28 handle of 14
30 recessed area in 28
32 second pivoting member of 14
34 periodontal head for 16
36 joint extension of 18
38 head extension of 18
40 retracting and extending paraphernalia of 14
42 open side socket in 18 of 20
44 groove in 42
46 base of 16
48 tongue on 46
50 joint for 24
52 top compartment in 22
54 locking rod extension unit of 26
56 cover plate thumb grip of 26
58 spring of 56
60 gear teeth on 24 at 18
62 spring biased pin of 26
64 slide button of 26 on 22
65 hinge for 32
66 bristle toothbrush attachment for 34
68 dental floss attachment for 34
70 tongue massager/scrapper attachment for 34
72 dental mirror attachment for 34
74 tartar scrapper attachment for 34
76 flexible dental mirror attachment for 34
78 cross-bristle toothbrush attachment for 34
80 first spiral bevel gear of 40 in 24
82 shank of 38
84 threaded bore in 82
86 second smaller spiral bevel gear of 40 in 90

88 screw rod of 40 in 90
90 aperture in 36
92 ratchet wheel of 68 in 46
94 central socket in 92
96 pawl arm of 68
98 one end of 96
100 button of 96
102 cover of 68
104 aperture in 102
106 stationary bent arm on 102
108 top slot in 106, 112
110 side indent in 106, 112
112 movable bent arm
114 bottom plug on 112
116 piece of dental floss of 68
118 projection on 116
120 compressible hollow ball
122 small valve in 120

It will be understood that each of the elements described above, or two or more together may also find a useful application in other types of methods differing from the type described above.

While certain novel features of this invention have been shown and described are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. A tri-fold multipurpose toothbrush which comprises:

a) means for cleaning teeth;

b) an arm assembly;

c) means on a first end of said arm assembly for retaining said teeth cleaning means thereto in a removable manner;

d) a case;

e) means at a second end of said arm assembly for pivoting said arm assembly on a first end of said case, so that said arm assembly with said teeth cleaning means can fold down upon said case when not in use and can fold out from said case when in use;

f) means for locking said arm assembly in any angle when folded out from said case, said locking means including:

i) said case having a top compartment;

ii) a locking rod extension unit carried in said top compartment;

iii) a cover plate thumb grip with a spring placed over said locking rod extension unit in said top compartment, so that said cover plate thumb grid can be depressed into said top compartment by said teeth cleaning means when said arm assembly is folded down and by a thumb of a person when said arm assembly is folded out;

iv) said first pivoting means on the second end of said arm assembly having gear teeth thereon;

v) a spring biased pin carried in said case and in engagement with said locking rod extension unit, so that when said cover plate thumb grip is depressed down by the thumb of the person said pin will engage with said gear teeth to hold said arm assembly stationary at an angle thereto; and vi) a slide button carried on said case and in engagement with said pin, so that when said button is manually pulled back said pin will disengage from said gear teeth, to allow said arm assembly to pivot freely on said first pivoting means;

g) a handle having a recessed area; and h) means at a first end of said handle for pivoting said handle on a second end of said case, so that said handle can fold down upon said case with the recessed area over said arm assembly with said teeth cleaning means when not in use, and said handle can fold out from said case to be gripped by a hand of a person when in use.

2. A tri-fold multipurpose toothbrush as recited in claim 1, wherein said teeth cleaning means is a periodontal head.

3. A tri-fold multipurpose toothbrush as recited in claim 2, wherein said periodontal head is selected from the group consisting of a bristle toothbrush attachment, a dental floss attachment, a tongue massager/scraper attachment, a dental mirror attachment, a tartar scraper attachment, a flexible dental mirror attachment and a cross-bristle toothbrush attachment.

4. A tri-fold multipurpose toothbrush as recited in claim 2, wherein said arm assembly includes:

a) a joint extension; and b) a head extension in which a part thereof slides within said joint extension.

5. A tri-fold multipurpose toothbrush as recited in claim 4, further including means extending within said joint extension and said head extension, for retracting part of said head extension into said joint extension when folded down upon said case and for extending part of said head extension out from said joint extension, when folded out from said case.

6. A tri-fold multipurpose toothbrush as recited in claim 5, wherein said retaining means includes:

a) said arm assembly having an open side socket with a groove formed in each opposite end of said socket; and b) said teeth cleaning means having a base with a tongue formed on each opposite end of said base, so that said base can slide within said socket with said tongues in engagement with said grooves.

7. A tri-fold multipurpose toothbrush as recited in claim 6, wherein said first pivoting means is a joint formed on the second end of said arm assembly and the first end of said case.

8. A tri-fold multipurpose toothbrush as recited in claim 7, wherein said second pivoting means is a hinge formed on the first end of said handle and the second end of said case.

9. A tri-fold multipurpose toothbrush as recited in claim 8, wherein said periodontal head is selected from the group consisting of a bristle toothbrush attachment, a dental floss attachment, a tongue massager/scraper attachment, a dental mirror attachment, a tartar scraper attachment, a flexible dental mirror attachment and a cross-bristle toothbrush attachment.

10. A tri-fold multipurpose toothbrush as recited in claim 9, wherein said retracting and extending means includes:

a) a first spiral bevel gear carried within said first pivoting means;

b) said head extension having a shank with a threaded bore therein;

c) a second smaller spiral bevel gear in engagement with said first spiral bevel gear with intersecting axes;

d) a screw rod affixed at one end to said second smaller spiral bevel gear, whereby said screw rod and said second smaller spiral bevel gear are rotatively carried within an aperture in said joint extension, while a free end of said screw rod is threaded into said threaded bore in said shank of said head extension, so that when said joint extension folds down on said case, said shank of said head extension will be pulled into said joint extension.

11. A tri-fold multipurpose toothbrush as recited in claim 10, wherein said periodontal head is a dental floss attachment including:

a) said base being hollow;

b) a ratchet wheel having a central socket and rotatively mounted within said base;

c) a pawl arm pivotally mounted at one end within said base at a first side thereof and having a button extending outwardly from a second side of said base, so that a person can manually operate said pawl arm to engage with and disengage with said ratchet wheel;

d) a cover having an aperture therethrough, whereby said cover is connected onto said base, so that said aperture will be over the central socket of said ratchet wheel;

e) a stationary bent arm affixed to said cover, said stationary bent arm having a top slot with a side indent;

f) a movable bent arm having a bottom plug and a top slot with a side indent, so that said bottom plug can engage with the central socket of said ratchet wheel;

g) a piece of dental floss having a projection on each end thereof, so that when said pawl arm is disengaged from said ratchet wheel, said movable bent arm can be pushed closer to said stationary bent arm to allow said piece of dental floss to be inserted into the top slots and said movable bent arm can be pulled away from said stationary bent arm, causing the projections to lock into the side indents and said piece of dental floss becoming taught therebetween;

h) a compressible hollow ball molded to said cover; and i) a small valve in said ball to release air slowly and preventing said piece of dental floss from slipping too quickly between teeth, due to force, and injure the gum, whereby when pressure is removed from said ball, said valve will allow quick air intake back into said ball to return said ball to its original shape.

12. A tri-fold multipurpose toothbrush as recited in claim 1, wherein said arm assembly includes:

a) a joint extension; and b) a head extension in which a part thereof slides within said joint extension.

13. A tri-fold multipurpose toothbrush as recited in claim 12, further including means extending within said joint extension and said head extension, for retracting part of said head extension into said joint extension when folded down upon said case and for extending part of said head extension out from said joint extension, when folded out from said case.

14. A tri-fold multipurpose toothbrush as recited in claim 1, wherein said retaining means includes:

a) said arm assembly having an open side socket with a groove formed in each opposite end of said socket; and b) said teeth cleaning means having a base with a tongue formed on each opposite end of said base, so that said base can slide within said socket with said tongues in engagement with said grooves.

15. A tri-fold multipurpose toothbrush as recited in claim 1, wherein said first pivoting means is a joint formed on the second end of said arm assembly and the first end of said case.

16. A tri-fold multipurpose toothbrush as recited in claim 1, wherein said second pivoting means is a hinge formed on the first end of said handle and the second end of said case.

17. A tri-fold multipurpose toothbrush which comprises:

a) means for cleaning teeth;

b) an arm assembly including a joint extension and a head extension in which a part thereof slides within said joint extension;

c) means on a first end of said arm assembly for retaining said teeth cleaning means thereto in a removable manner;

d) a case;

e) means at a second end of said arm assembly for pivoting said arm assembly on a first end of said case, so that said arm assembly with said teeth cleaning means can fold down upon said case when not in use and can fold out from said case when in use;

f) means for locking said arm assembly in any angle when folded out from said case;

g) a handle having a recessed area;

h) means at a first end of said handle for pivoting said handle on a second end of said case, so that said handle can fold down upon said case with the recessed area over said arm assembly with said teeth cleaning means when not in use, and said handle can fold out from said case to be gripped by a hand of a person when in use; and i) means extending within said joint extension and said head extension, for retracting part of said head extension into said joint extension when folded down upon said case and for extending part of said head extension out from said joint extension, when folded out from said case, wherein said retracting and extending means includes:

i) a first spiral bevel gear carried within said first pivoting means;

ii) said head extension having a shank with a threaded bore therein;

iii) a second smaller spiral bevel gear in engagement with said first spiral bevel gear with intersecting axes; and iv) a screw rod affixed at one end to said second smaller spiral bevel gear, whereby said screw rod and said second smaller spiral bevel gear are rotatively carried within an aperture in said joint extension, while a free end of said screw rod is threaded into said threaded bore in said shank of said head extension, so that when said joint extension folds down on said case, said shank of said head extension will be pulled into said joint extension.

18. A tri-fold multipurpose toothbrush which comprises:

a) a dental floss attachment, wherein said dental floss attachment includes:

i) a hollow base;

ii) a ratchet wheel having a central socket and rotatively mounted within said base;

iii) a pawl arm pivotally mounted at one end within said base at a first side thereof and having a button extending outwardly from a second side of said base, so that a person can manually operate said pawl arm to engage with and disengage with said ratchet wheel;

iv) a cover having an aperture therethrough, whereby said cover is connected onto said base, so that said aperture will be over the central socket of said ratchet wheel;

v) a stationary bent arm affixed to said cover, said stationary bent arm having a top slot with a side indent;

vi) a movable bent arm having a bottom plug and a top slot with a side indent, so that said bottom plug can engage with the central socket of said ratchet wheel through said aperture in said cover;

vii) a piece of dental floss having a projection on each end thereof, so that when said pawl arm is disengaged from said ratchet wheel, said movable bent arm can be pushed closer to said stationary bent arm to allow said piece of dental floss to be inserted into the top slots and said movable bent arm can be pulled away from said stationary bent arm, causing the projections to lock into the side indents with said piece of dental floss becoming taut therebetween;

viii) a compressible hollow ball molded to said cover; and ix) a small valve in said ball to release air slowly and prevent said piece of dental floss from slipping too quickly between teeth, due to force, and injuring the gum, whereby when pressure is removed from said ball, said valve will allow quick air intake back into said ball to return said ball to its original shape;

b) an arm assembly;

c) means on a first end of said arm assembly for retaining said dental floss attachment thereto in a removable manner;

d) a case;

e) means at a second end of said arm assembly for pivoting said arm assembly on a first end of said case, so that said arm assembly with said dental floss attachment can fold down upon said case when not in use and can fold out from said case when in use;

f) means for locking said arm assembly in any angle when folded out from said case;

g) a handle having a recessed area; and h) means at a first end of said handle for pivoting said handle on a second end of said case, so that said handle can fold down upon said case with the recessed area over said arm assembly with said dental floss attachment when not in use, and said handle can fold out from said case to be gripped by a hand of a person when in use.

* * * * *